US005114697A

United States Patent [19]

Naito et al.

[11] Patent Number: 5,114,697

[45] Date of Patent: May 19, 1992

[54] HIGH STRENGTH, HIGH MODULUS PITCH-BASED CARBON FIBER

[75] Inventors: Tsutomu Naito; Genshiro Nishimura; Kikuji Komine, all of Tokyo, Japan

[73] Assignee: Toa Nenryo Kogyo Kabushiki Kaisha, Tokyo, Japan

[21] Appl. No.: 327,637

[22] Filed: Mar. 23, 1989

[30] Foreign Application Priority Data

Mar. 28, 1988 [JP] Japan ..... 63-73779
Mar. 3, 1989 [JP] Japan ..... 1-49779

[51] Int. Cl.[5] ..... D01F 9/12

[52] U.S. Cl. ..... 423/447.1; 423/447.2; 423/447.4; 423/447.6; 264/29.2

[58] Field of Search ..... 423/447.1, 447.2, 447.4, 423/447.6; 264/29.2

[56] References Cited

U.S. PATENT DOCUMENTS

| | | | |
|---|---|---|---|
| 3,919,376 | 11/1975 | Schultz | 264/102 |
| 3,919,387 | 11/1975 | Singer | 264/344 |
| 3,974,264 | 8/1976 | McHenry | 423/447.4 |
| 3,995,014 | 11/1976 | Lewis | 423/447.4 |
| 4,005,183 | 1/1977 | Singer | 423/447.4 |
| 4,017,327 | 4/1977 | Lewis et al. | 106/273 R |
| 4,209,500 | 6/1980 | Chwastiak | 423/447.6 |
| 4,331,620 | 5/1982 | Drefendorf et al. | 423/447.4 |
| 4,472,265 | 9/1984 | Otoni et al. | 423/447.1 |
| 4,554,148 | 11/1985 | Gomi et al. | 423/447.1 |
| 4,655,902 | 4/1987 | Izumi et al. | 423/447.2 |
| 4,670,129 | 6/1987 | Tate et al. | 264/29.2 |
| 4,717,331 | 1/1988 | Maeda et al. | 423/447.2 |
| 4,775,589 | 10/1988 | Hamada et al. | 423/447.1 |
| 4,814,121 | 3/1989 | Watanabe | 423/447.1 |
| 4,822,587 | 4/1989 | Hino et al. | 423/447.1 |
| 4,898,723 | 2/1990 | Suto et al. | 423/447.4 |
| 4,913,889 | 4/1990 | Takai et al. | 423/447.4 |

FOREIGN PATENT DOCUMENTS

| | | | |
|---|---|---|---|
| 294112 | 12/1988 | European Pat. Off. | 264/29.2 |
| 8501752 | 4/1985 | PCT Int'l Appl. | 264/29.2 |
| 2131781 | 6/1984 | United Kingdom | 264/29.2 |

*Primary Examiner*—Robert Kunemund
*Attorney, Agent, or Firm*—Seidel, Gonda, Lavorgna & Monaco

[57] ABSTRACT

A high strength, high modulus pitch-based carbon fiber has a crystalline structure in which the presence of the (112) cross-lattice line and the resolution of the diffraction band into the (100) and (101) diffraction lines, which indicate the three-dimensional order of the crystallite of the fiber, are not recognized, and in which the orientation angle ($\phi$) of X-ray structural parameter is not greater than 12° and the stack height (Lc) ranges between 80 and 180 Å. The carbon fiber also has a single-fiber diameter of 5 to 12 $\mu$m, tensile strength not lower than 3.0 GPa, tensile elastic modulus not smaller than 500 GPa and elongation not smaller than 0.5%.

8 Claims, 2 Drawing Sheets

HIGH STRENGTH, HIGH MODULUS PITCH-BASED CARBON FIBER

BACKGROUND OF THE INVENTION

1. Field of the Invention

The present invention broadly relates to a carbon fiber and, more particularly, to a high strength, high modulus pitch-based carbon fiber suitable for use as a reinforcing fiber for light-weight structural material in various industrial fields such as space, automotive and architectural industries.

2. Description of the Related Art

Hitherto, PAN-based carbon fibers have been manufactured and used widely amongst various types of carbon fibers or graphite fibers. In general, PAN-based carbon fibers exhibit superior characteristics, in particular high tensile strength, as compared with pitchbased carbon fibers and, therefore, are used as high strength carbon fibers in various fields. Unfortunately, however, PAN-based carbon fibers show a rather low elastic modulus, e.g., 290 GPa, though some of this type of fibers have very high tensile strength of 5.6 GPa. This is attributable to a fact that high level of elastic modulus can hardly be attained with this type of carbon fibers due to the presence of a practical limit in the crystallization, i.e., degree of graphitization, because of inferior graphitability of this type of carbon fibers. In addition, PAN-based carbon fibers have drawbacks such as high material costs, and are not preferred from the view points of carbonization yield and economy.

Under these circumstances, methods have been proposed for producing pitch-based carbon fibers and graphite fibers which have superior tensile strength and tensile elastic modulus from pitch which is inexpensive.

For instance, Japanese Patent Application KOKOKU No. 60-4286 (U.S. Pat. 4,005,183) discloses a method which has the steps of heating a pitch at a temperature of 350 to 450° C. until about 40 to 90 wt% of meso-phase is generated, spinning a fiber of a carbonaceous pitch which exhibits non-thixotropic characteristic and a viscosity of 10 to 200 poise at the spinning temperature, infusiblizing the spun fiber in an oxygen-containing atmosphere at a temperature of 250 to 400° C., heating the infusiblized fiber to a temperature not lower than 1000° C. in an inert gas atmosphere, and further heating the fiber to a temperature not lower than 2500° C., whereby a graphite fiber is produced which exhibits presence of the (112) cross-lattice line and resolution of the (100) and (101) diffraction lines, which indicate the three-dimensional order of the crystallite of the fiber, and which has an interlayer spacing ($d_{002}$) of 3.37Å or less and a stack height (Lc) of 1000Å or greater.

The graphite fiber heated to 2800° C. as disclosed in the above-mentioned publication shows a tensile strength of about 1.7 to 2.4 GPa (about $250\times10^3$ to $350\times10^3$ psi) and a tensile elastic modulus of about 520 to 830 GPa about $75\times10^6$ to $120\times10^6$ psi).

On the other hand, Japanese Patent Application KOKAI No. 62-104927 (U.S. Pat. 4,775,589) teaches that a pitch-based carbon fiber, which has an orientation angle (Φ) smaller than 10°, a stack height (Lc) of 180 to 250Å, and an interlayer spacing ($d_{002}$) of 3.38 to 3.45Å, can be formed from a coal-tar pitch. This pitch-based carbon fiber, however, exhibits a small elongation of 0.38 to 0.43%, though it provides a tensile strength of 2.6 to 3.3 GPa (265 to 333 Kg/mmz) and a tensile elastic modulus of 608 to 853 GPa (62 to 87 ton/mm$^2$).

Furthermore, Japanese Patent Application KOKAI No. 61-83319 discloses a pitch-based carbon fiber produced from naphthalene through a heat-treatment at a temperature of 2000° C. or higher, the carbon fiber having an orientation angle (Φ) smaller than 30°, preferably 15 to 25°, a stack height (Lc) greater than 80A but not greater than 200Å, preferably 90 to 170A, and an interlayer spacing ($d_{002}$) of 3.371 to 3.440Å.

This pitch-based carbon fiber exhibits a tensile strength of 3.1 to 3.9 GPa (318 to 394 Kg/mm$^2$), a tensile elastic modulus of 234 to 412 GPa (23900 to 42000 Kg/mm$^2$) and an elongation of 0.9 to 1.4%. In addition, the production cost is high due to the use of naphthalene which is expensive.

Thus, the conventional pitch-based carbon fibers, as can be understood from the above, are inferior at least in elongation and, hence, are difficult to handle. This poses a problem particularly in the production of composite materials.

It is true that the above-mentioned pitch-based carbon fiber produced from naphthalene exhibits a considerably large elongation. This carbon fiber, however, is disadvantageous in that the tensile elastic modulus is small and in that the material cost is high.

SUMMARY OF THE INVENTION

In the course of an intense study for development of a technique which would enable production of a pitch-based carbon fiber having high values of elastic modulus, tensile strength and elongation, the present inventors have found that high tensile strength, high elastic modulus and large elongation are simultaneously attainable with a pitch-based carbon fiber by realizing a unique crystalline structure of the carbon fiber.

The present invention is based upon this discovery.

Accordingly, an object of the present invention is to provide a carbon fiber which is excellent in performance, in particular in terms of elastic modulus, strength and elongation.

Another object of the present invention is to provide a carbon fiber which is excellent in performance, in particular in terms of elastic modulus, strength and elongation and which is easy to handle and particularly easy to manufacture composite materials.

To this end, according to the present invention, there is provided a pitch-based carbon fiber having a crystalline structure in which the presence of the (112) cross-lattice line and the resolution of the diffraction band into the (100) and (101) diffraction lines, which indicate the three-dimensional order of the crystallite of the fiber, are not recognized, and in which the orientation angle (Φ) of X-ray structural parameter is not greater than 12° and the stack height (Lc) ranges between 80 and 180Å, the carbon fiber also having a single-fiber diameter of 5 to 12 μm, tensile strength not lower than 3.0 GPa, tensile elastic modulus not smaller than 500 GPa and elongation not smaller than 0.5%.

Preferably, the carbon fiber has an interlayer spacing ($d_{002}$) which ranges between 3.40 and 3.45Å. The orientation angle (Φ) preferably ranges between 5 and 10°, while the stack height (Lc) preferably ranges between 100 and 160Å.

As stated above, the present inventors have found that a carbon fiber having excellent performance, particularly in terms of elastic modulus, tensile strength and elongation, can be obtained with a novel crystalline structure.

More specifically, the present inventors have found that, in order to obtain a carbon fiber having well-balanced properties in terms of high elastic modulus, high tensile strength and large elongation, it is preferred that the presence of the (112) cross-lattice line and the resolution of the diffraction band into the (100) and (101) diffraction lines, which indicate the three-dimensional order of the crystallite of the fiber, are not recognized, and that the orientation angle (Φ) and the stack height (Lc) are suitably determined in good balance with each other.

A description will be given in more detail of the high strength, high modulus carbon fiber in accordance with the present invention.

It is well known that the elastic modulus of a carbon fiber can be increased by an improvement in the crystallinity. However, commercially available pitch-based carbon fibers generally exhibit small tensile strength, say 2.2 GPa, so that improvement in the crystallinity alone cannot provide a high-performance carbon fiber having excellent elastic modulus, tensile strength and elongation.

The present inventors studied correlation between physical properties and structure of carbon fibers and found that a mere improvement in the elastic modulus is attainable by enhancing the crystallinity to such a degree as to enable recognition of both the presence of the (112) cross lattice line and the resolution of the diffraction band into the (100) and (101) diffraction lines, which indicate the three-dimensional order of the crystallite of the fiber, but such an enhancement in the crystallinity is undesirably accompanied by a reduction in the tensile strength. Thus, it is understood that the presence of the(112) cross-lattice line and the resolution of the diffraction band into the(100) and (101) diffraction lines are not observed, in order that high tensile strength and large elongation are obtained simultaneously with an improved elastic modulus. It is also understood that, in order to develop a high tensile strength, it is preferable to make the crystalline structure smaller and finer and very important to attain a suitable balance of the stack height (Lc) and t he orientation angle (Φ) which are major factors for determining the crystal size, and that as a result elongation of carbon fibers is improved as wells.

Consequently, the present inventors have confirmed through study and experiment that superior mechanical properties of carbon fibers can be obtained when the conditions that the orientation angle (Φ) of the X-ray structural parameter is not greater than 12° and that the stack height (Lc) is 80 to 180Å are simultaneously met. Preferably, the orientation angle is 5 to 10° and the stack height is 100 to 160Å. The inventors also confirmed that in order to develop a high tensile strength the interlayer spacing ($d_{002}$) preferably ranges between 3.40 and 3.45Å.

More specifically, the experiment conducted by the present inventors showed that the crystalline structure of the carbon fiber is preferably such that the presence of the (112) cross-lattice line and the resolution of the diffraction band into the (100) and (101) diffraction lines, which indicate the three dimensional order, are not observed, in order to attain high tensile strength and large elongation together with an appreciable level of elastic modulus. The experiment also showed that an orientation angle exceeding 12° undesirably reduces the elastic modulus of the product carbon fiber. A stack height exceeding 160Å makes it difficult to obtain sufficient strength of the carbon fiber, while a stack height below 80Å makes it difficult to attain satisfactorily high elastic modulus.

The carbon fiber of the present invention, featuring the orientation angle not greater than 12°, stack height of 80 to 180Å and elongation not smaller than 0.5%, provides high levels of elastic modulus, tensile strength and elongation simultaneously. The elongation exhibited by the carbon fiber of the present invention is still higher than that of conventionally used high modulus carbon fibers, thus overcoming the problem of known high modulus carbon fibers, i.e., fragility.

The carbon fiber in accordance with the present invention can be produced by the following process.

Using a spinning nozzle incorporating an insert member having a high heat conductivity, a carbonaceous pitch fiber is spun while minimizing fluctuation of temperature of the molten pitch in the spinning nozzle, in particular by minimizing temperature drop. The thus obtained pitch fiber is subjected to an infusiblizing treatment which is conducted in a nitrogen gas atmosphere by heating the fiber from a minimum temperature of 120 to 190° C. to a maximum temperature of 240 to 350° C. at a temperature rise rate of 0.005 to 0.1° C./min, under a tension of 0.0001 to 0.2 gr per filament. The infusiblized fiber is then heated in an inert gas such as argon gas up to 1000° C. at a temperature rising rate of 0.1 to 10° C./min and further to a maximum temperature of 1700 to 2500° C. at a temperature rising rate of 10 to 500° C./min, whereby a carbon fiber having a large elongation of 0.5 to 1.0%, as well as high elastic modulus and strength, is produced at a high carbonization yield.

The above and other objects, features and advantages of the present invention will become clear from the following description of the preferred embodiments.

DESCRIPTION OF THE PREFERRED EMBODIMENT

Figure 1:
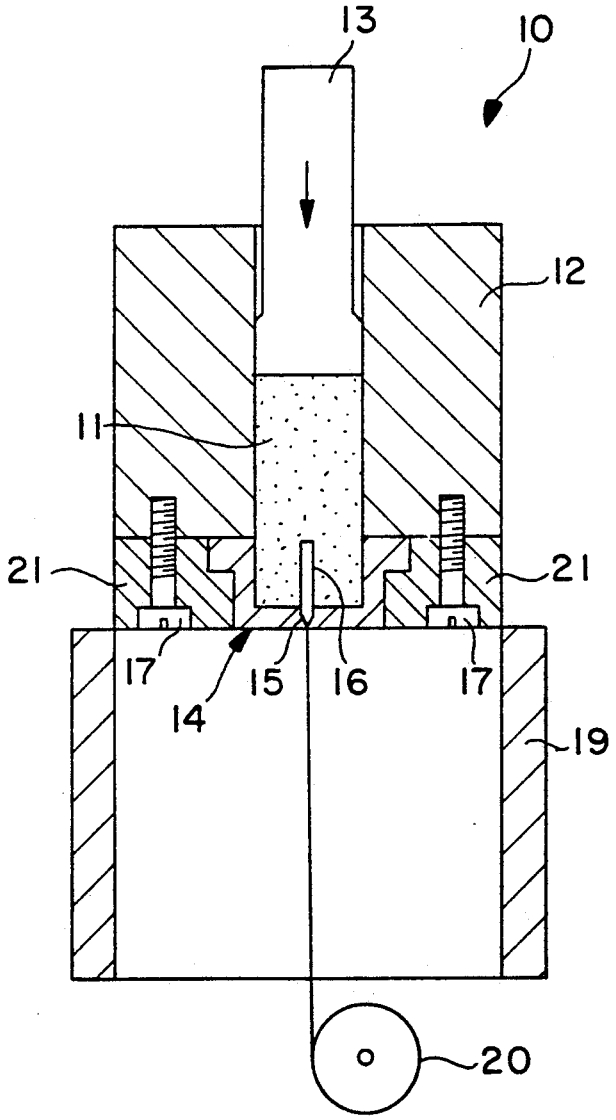
FIG. 1 is a sectional view of an example of a spinneret in a spinning apparatus suitable for use in the production of a carbon fiber in accordance with the present invention.

The high strength, high modulus pitch-based carbon fiber of the present invention will be more fully understood from the following description of a preferred embodiment.

The properties or characteristics of the carbon fiber were measured by using the following method. * X-ray structural parameters The orientation angle (Φ), stack height ($L_{c002}$) and the interlayer spacing ($d_{002}$) are parameters which describe the the fine structure of a carbon fiber as determined through a wide angle X-ray diffraction.

The orientation angle (Φ) represents the degree of preferred orientation of the crystallite with respect to the fiber axis direction. Thus, a smaller orientation angle (Φ) suggests a higher degree of orientation. The stack height ($L_{c002}$) shows the apparent thickness of the laminate of the (002) planes in the carbon fine crystallite. In general, a greater stack height ($L_{c002}$) is considered to indicate a greater degree of crystallinity. The interlayer spacing ($d_{002}$) represents the spacing of the (002) planes of the fine crystallite. Smaller value of the interlayer spacing ($d_{002}$) suggests a higher degree of crystallinity.

The orientation angle (Φ) is measured by using a fiber specimen holder. A counter tube is scanned in a state in which a fiber bundle is maintained perpendicular to the scan plane of the counter tube and the diffraction angle $2\iota$ (about 26°) at which the intensity of the (002) diffraction pattern is maximized is measured. Then, while maintaining the counter tube in this state, the fiber specimen holder is rotated 360° and the intensity distribution of the (002) diffraction ring is measured and the FWHM, i.e., the full width of the half maximum of the diffraction pattern, at the point corresponding to ½ of the maximum intensity is determined as the orientation angle (Φ).

The stack height ($L_{002}$) and the interlayer spacing ($d_{002}$) are determined by grinding the fibers into powders in a mortar and conducting measurement and analysis in accordance with Gakushinho "Measuring Method for Lattice Constant and Crystalline Size of Artificial Graphite" and then applying the following formulae:

$$L_{002} = K\lambda / \beta \cos\theta$$

$$d_{002} = \lambda\ 2 \sin\theta$$

where $K = 1.0$, $\lambda = 1.5418$Å

$\theta$: determined from (002) diffraction angle $2\theta$ $\beta$: the FWHM of (002) diffraction pattern calculated with correction Judgment as to the presence of the (112) cross-lattice line and the resolution of the diffraction band into the (100) and (101) diffraction lines were conducted using spectra of sufficiently high S/N ratio, by measuring the range to be observed applying a step scan method for several hours or more.

EXAMPLE 1

A carbonaceous pitch containing about 50% of optically anisotropic phase (AP) was used as a precursor pitch. The pitch was centrifuged in a cylindrical continuous centrifugal separator having an effective rotor internal volume of 200 ml at a rotor temperature of 350° C. under application of a centrifugal force of 10000G, and a separated portion of the centrifuged pitch was extracted from an AP drain port of the separator. The thus obtained pitch has contained 98% of optically anisotropic phase and a softening point of 268° C.

Figure 2:
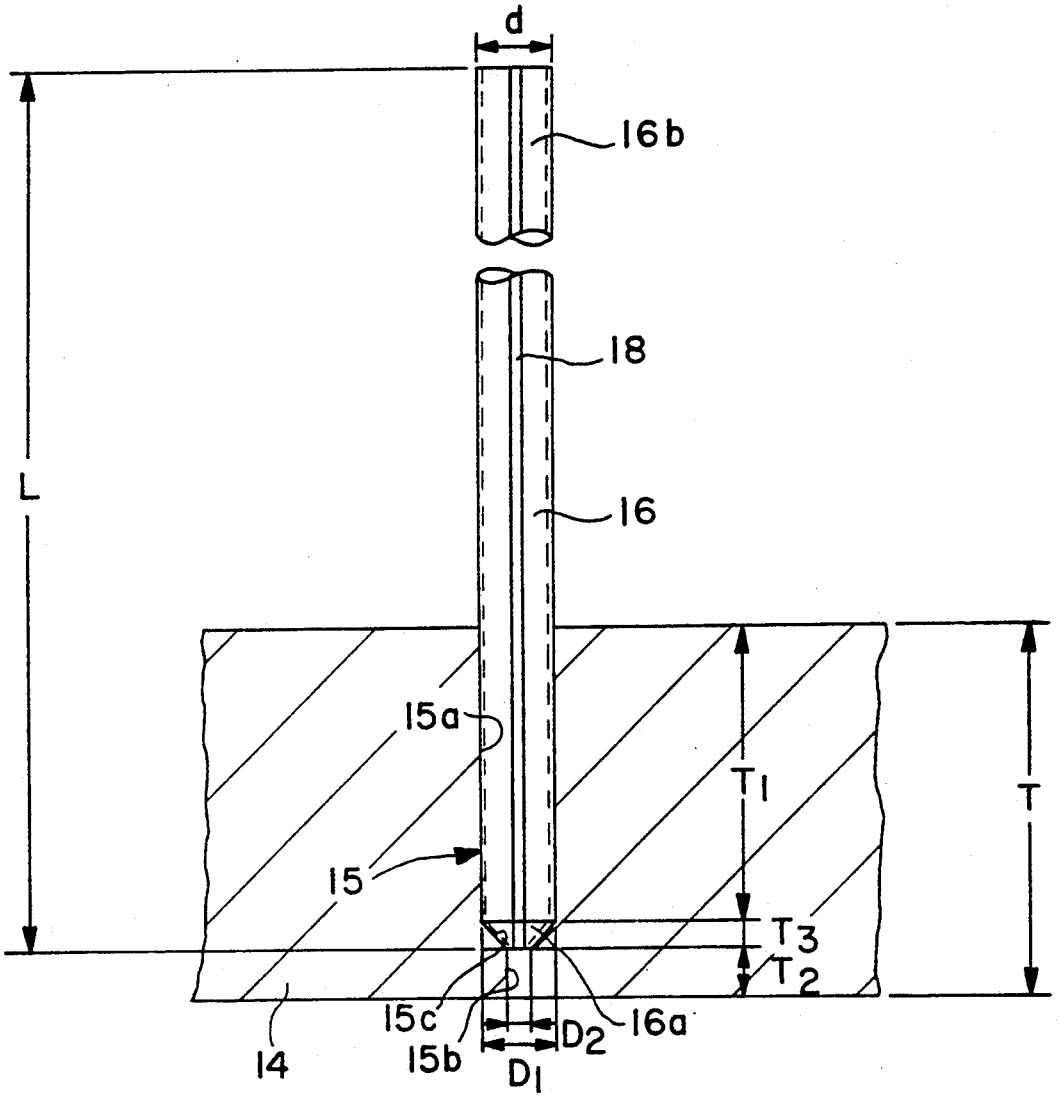
FIG. 2 is a sectional view of an example of an insert member used in the spinneret of FIG. 1.
Figure 3:
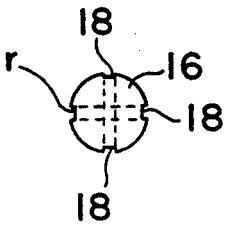
FIG. 3 is a plan view of the insert member shown in FIG. 1.

The pitch was spun at 340° C. through a melt spinning apparatus having a nozzle diameter of 0.3 mm. The spinning apparatus and the spinneret used in the spinning are shown in FIGS. 1 to 3.

The spinning apparatus 10 has a heating cylinder 12 adapted to be charged with a molten pitch 11 from a pitch pipe, a plunger 13 for pressurizing the pitch in the cylinder 12, and a spinneret 14 attached to the lower side of the heating cylinder 12. The spinneret 14 is provided with a spinning nozzle 15 and is detachably secured to the underside of the heating cylinder 12 by means of a bolts 17 and spinneret retainers 18. The spun pitch fiber was wound up on a bobbin 20 through a spinning cylinder 19.

The spinning nozzle 15 provided in the spinneret 14 used in this Example has a large-diameter nozzle introductory part **15*a* and a small-diameter nozzle part 15*b* formed in communication with the nozzle introductory part 15*a*. A frusto-conical nozzle transient portion 15*c* is formed between the nozzle introductory part 15*a* and the nozzle part 15*b*. The transient portion 15*c* of the spinning nozzle has the length ($T_3$) of 0.35 mm. The spinneret 14 is made from a stainless steel (SUS 304). The thickness (T) of the spinning nozzle 15 is 5 mm, while the lengths ($T_1$) and ($T_2$) of the large-diameter nozzle introductory part 15*a* and the small-diameter nozzle part 15*b* are 4 mm and 0.65 mm, respectively. The diameters ($D_1$) and ($D_2$) of these parts 15*a* and 15*b*** are 1 mm and 0.3 mm, respectively.

An insert member 16 made of a material having a greater heat conductivity than the spinneret 14, copper in this case, is placed in the large-diameter nozzle introductory part **15*a* of the spinning nozzle 15. The insert member 16 is an elongated rod-like member which has one end 16*a* positioned in the vicinity of the inlet of the small-diameter nozzle part 15*b* and the other end extended to the outside of the nozzle 15 through the inlet of the large-diameter nozzle introductory part 15*a*. The insert member has an overall length (L) of 20 mm and a diameter (d) which is determined to form an annular gap of 1/100 to 5/100 mm between the inner surface of the large-diameter nozzle introductory part 15*a* and the outer surface of the insert member 16 thereby ensuring that the insert member 16 can smoothly be inserted into and stably held in the large-diameter nozzle introductory part 15*a***.

In order to guide the flow of the molten pitch towards the nozzle part **15*b*, four axial grooves 18 having an arcuate cross-section of a radius (r) of 0.15 mm are formed in the surface of the insert member 16**.

This spinning apparatus could maintain the temperature drop of the molten pitch below 3° C. during the spinning through this spinning nozzle.

The thus obtained pitch fiber was infusiblized in a nitrogen gas atmosphere from a starting temperature of 160° C. up to a final temperature of 300° C., at a temperature rise rate of 0.01° C./min. During this treatment, a tension of 0.001 gr per filament was applied to the pitch fiber.

Upon completion of the infusiblization treatment, the pitch fiber is subjected to a pre-carbonization treatment by being heated up to a final temperature of 1000° C. at a temperature rise rate of 1° C./min in an argon gas atmosphere, followed by a carbonization treatment which was conducted by heating the pitch fiber up to 2000° C. at a temperature rise rate of 50° C./min, whereby a carbon fiber of about 9.8 μm dia. was obtained.

An X-ray diffraction was effected on the thus obtained carbon fiber. The presence of the(112) cross-lattice line and the resolution of the diffraction band into (100) and (101) diffraction lines to be indices of the three-dimensional order of the crystallite of the fiber were not recognized. The stack height ($L_{002}$), the orientation angle (Φ) and the interlayer spacing ($d_{002}$) were measured to be 140Å, 7.1° and 3.423Å, respectively. As to the physical properties, the tensile elastic modulus was 610 GPa, the tensile strength was 4.0 GPa and the elongation was 0.7%.

COMPARATIVE EXAMPLE 1

Using the same pitch as Example 1, spinning was conducted at a spinning temperature of 330° C. through a spinneret which was devoid of the insert member used in Example 1. The thus obtained pitch fiber was infusiblized by being heated from 130° C. to 255° C. at a temperature rising rate of 0.3° C./min in an air atmosphere. Then, treatments were conducted under the same conditions as Example 1.

An X-ray diffraction was effected on the thus obtained carbon fiber. The presence of the(112) cross-lattice line and the resolution of the diffraction band into (100) and (101) diffraction lines to be indices of the three-dimensional order were not recognized. The stack height ($L_{coo_2}$), orientation angle (Φ) and the interlayer spacing ($d_{oo_2}$) were measured to be 120Å, 15° and 3.430Å, respectively. As to the physical properties, the tensile elastic modulus was 380 GPa, the tensile strength was 2.8 GPa and the elongation was 0.7%.

COMPARATIVE EXAMPLE 2

Using the same pitch as Example 1, spinning was conducted at a spinning temperature of 340° C. through a spinneret which was devoid of the insert member used in Example 1. The thus obtained pitch fiber was infusiblized by being heated from 130° C. to 255° C. at a temperature rise rate of 0.3° C./min in an air atmosphere. The infusiblized carbon fiber was then heated in an argon gas atmosphere up to 3000° C. Then, treatments were conducted under the same conditions as Example 1.

An X-ray diffraction was effected on the thus obtained carbon fiber. Both the presence of the(112) cross-lattice line and the resolution of the diffraction band into (100) and (101) diffraction lines to be indices of the three-dimensional order were recognized. The stack height ($L_{coo_2}$), the orientation angle (Φ) and the interlayer spacing ($d_{oo_2}$) were measured to be 590Å, 5° and 3.375Å, respectively. As to the physical properties, the tensile elastic modulus was 750 GPa, the tensile strength was 2.3 GPa and the elongation was 0.3%.

COMPARATIVE EXAMPLE 3

Using the same pitch as Example 1, spinning was conducted at a spinning temperature of 310° C. through a spinneret which was devoid of the insert member used in Example 1. The thus obtained pitch fiber was infusiblized by being heated from 130° C. to 255° C at a temperature rise rate of 0.3° C./min in an air atmosphere. The infusiblized carbon fiber was then heated in an argon gas atmosphere up to 2600° C. Then, treatments were conducted under the same conditions as Example 1.

An X-ray diffraction was effected on the thus obtained carbon fiber. The presence of the(112) cross-lattice line and the resolution of the diffraction band into (100) and (101) diffraction lines to be indices of the three-dimensional order were not recognized. The stack height ($L_{coo_2}$), the orientation angle (Φ) and the interlayer spacing ($d_{oo_2}$) were measured to be 200Å, 14° and 3.394Å, respectively. As to the physical properties, the tensile elastic modulus was 480 GPa, the tensile strength was 2.1 GPa and the elongation was 0.4%.

EXAMPLE 2

A carbon fiber was prepared from the same material and by the same process as Example 1, except that the spinning temperature and the heating temperature were changed to 330° C. and 1900° C., respectively.

An X-ray diffraction was effected on the thus obtained carbon fiber. The presence of the(112) cross-lattice line and the resolution of the diffraction band into (100) and (101) diffraction lines to be indices of the three-dimensional order were not recognized. The stack height ($L_{coo_2}$), the orientation angle (Φ) and the interlayer spacing ($d_{oo_2}$) were measured to be 110A, 9.5° and 3.435Å, respectively. As to the physical properties, the tensile elastic modulus was 520 GPa, the tensile strength was 3.8 GPa and the elongation was 0.7%.

EXAMPLE 3

A carbon fiber was prepared from the same material and by the same process as Example 1, except that the spinning temperature and the heating temperature were changed to 345° C. and 2000° C., respectively.

An X-ray diffraction was effected on the thus obtained carbon fiber. The presence of the(112) cross-lattice line and the resolution of the diffraction band into (100) and (101) diffraction lines to be indices of the three-dimensional order were not recognized. The stack height ($L_{coo_2}$), the orientation angle (Φ) and the interlayer spacing ($d_{oo_2}$) were measured to be 150Å, 6.0° and 3.410Å, respectively. As to the physical properties, the tensile elastic modulus was 650 GPa, the tensile strength was 4.1 GPa and the elongation was 0.6%.

As will be understood from the foregoing description, the carbon fiber of the present invention having a unique and novel crystalline structure offers both a high tensile strength and a high elastic modulus, thus finding use as reinforcing fibers for light-weight structural materials of various fields such as space development, automotive production, architecture and so forth. It is also to be noted that, in the high strength, high modulus carbon fiber of the present invention, a large elongation of 0.5 to 1.0% is compatible with extremely high elastic modulus. This carbon fiber, when it is used in composite materials, offers not only a suitable reinforcing fiber for composite materials but also a high production efficiency by virtue of easiness of the fiber handling during the production of composite materials, thanks to the high strength and large elongation which add to the high elastic modulus.

What is claimed is:

1. A high strength, high modulus pitchbased carbon fiber comprising a crystalline structure in which the presence of the (112) cross-lattice line and the resolution of the diffraction band into the (100) and (101) defraction lines, which indicate the 3-dimensional order of the crystallite of the fiber, are not recognized, and in which the orientation angle (Φ) of X-ray structural parameter is not greater than 12° and the stack height (Lc) ranges between 80 and 180Å, said carbon fiber also having a single-fiber diameter of 5 to 12μm, tensile strength not lower than 3.0 GPa, tensile elastic modulus not smaller than 500 GPa and elongation n to smaller than 0.5%.

2. A high strength, high modulus carbon fiber according to claim 1, wherein the interlayer spacing ($d_{oo_2}$) of said crystalline structure ranges between 3.40 and 3.5Å.

3. A high strength, high modulus carbon fiber according to claim 1, wherein said orientation angle (Φ) ranges between 5 and 10° and said stack height ranges between 100 and 160Å.

4. A high strength, high modulus carbon fiber according to claim 2, wherein said orientation angle (Φ) ranges between 5 and 10° and said tack height (Lc) ranges between 100 and 160Å.

5. A high strength, high modulus pitch-based carbon fiber comprising a crystalline structure in which the presence of the (112) cross-lattice line and the resolution of the diffraction band into the (100) and (101) defraction lines, which indicate the 3-dimensional order of the crystallite of t he fiber, are not recognized, and in which the orientation angle (Φ) of X-ray structural parameter is not greater than 12° and the stack height (Lc) ranges between 80 and 180Å, said carbon fiber also having a single-fiber diameter of 5 to 12μm, tensile strength not lower than 3.0 GPa, tensile elastic modulus not smaller than 500 GPa and elongation not smaller than 0.5%, said carbon fiber being prepared by a process comprising the steps of:

(a) spinning of mesophase molten pitch to obtain a pitch fiber wherein the temperature drop of the pitch is maintained at a level below about 3° C. by using a nozzle which incorporates an insert member having a high heat conductivity.

(b) infusibilizing said pitch fiber by heating said pitch fiber in an atmosphere of an inert gas from a minimum temperature ranging from about 120° C to about 190° C. to a maximum temperature ranging from about 240° C. to about 350° C. at a heating rate of about 0.005° C./minute to about 0.1° C./minute, while said pitch fiber is under a tension ranging from about 0.0001 gram per filament to about 0.2 gram per filament, and (c) carbonizing said infusibilized fiber by heating said infusibilized fiber in an inert gas atmosphere up to a temperature of about 1,000° C. at a rate of about 0.1° C./minute to about 10° C./minute, and thereafter heating said infusibilized fiber to a maximum temperature ranging from about 1,700° C. to about 2,500° C. at a rage of about 10° C./minute to about 500° C./minute.

6. A high strength, high modulus carbon fiber according to claim 5, wherein the interlayer spacing ($D_{oo}^2$) of said crystalline structure ranges between 3.40 and 3.45Å.

7. A high strength, high modulus carbon fibre according to claim 5 wherein said orientation angle (Φ) ranges between 5 and 10° and said stack height (Lc) ranges between 100 and 160 Å.

8. A high strength, high modulus carbon fibre according to claim 6 wherein said orientation angle (Φ) ranges between 5 and 10° and said stack height (Lc) ranges between 100 and 160 Å.

* * * * *

UNITED STATES PATENT AND TRADEMARK OFFICE

CERTIFICATE OF CORRECTION

PATENT NO. : 5,114,697

DATED : May 19, 1992

INVENTOR(S) : Tsutomu Naito, et al.

It is certified that error appears in the above-identified patent and that said Letters Patent is hereby corrected as shown below:

Column 5, line 27, please delete "$doo_2 = \lambda 2 \sin\theta$" and substitute therefor -- "$doo_2 = \lambda/2\sin\theta$".

Column 8, line 53, after "elongation" delete "n to" and substitute therefor --not--.

Column 9, line 3, after "of" delete "t he" and substitute therefor --the--.

Column 10, line 13, before "of" delete "$Doo^2$" and substitute therefor --$doo_2$--.

Signed and Sealed this

Seventeenth Day of August, 1993

Bruce Lehman

*Attest:*

BRUCE LEHMAN

*Attesting Officer*

*Commissioner of Patents and Trademarks*